US005350149A

United States Patent [19]

Evans, Jr. et al.

[11] Patent Number: 5,350,149

[45] Date of Patent: Sep. 27, 1994

[54] CHRISTMAS TREE STAND

[75] Inventors: Ernest B. Evans, Jr., Peachtree City, Ga.; Hines E. Fulk, Jr., Kernersville, N.C.; Norman T. Bennett, Kernersville, N.C.; Dana R. Wilkerson, Kernersville, N.C.

[73] Assignee: Symple Products, Inc., Kernersville, N.C.

[21] Appl. No.: 17,621

[22] Filed: Feb. 16, 1993

[51] Int. Cl.[5] ..... A01K 97/10

[52] U.S. Cl. ..... 248/523; 47/40.5

[58] Field of Search ..... 248/523, 519, 522, 524, 248/521, 525, 526, 527; 47/405

[56] References Cited

U.S. PATENT DOCUMENTS

| | | | |
|---|---|---|---|
| 646,364 | 3/1900 | Donnelly | 248/523 |
| 1,943,269 | 1/1934 | Holden | 248/524 |
| 2,905,414 | 9/1959 | Zierden . | |
| 3,250,504 | 5/1966 | Schwaderlapp . | |
| 3,272,462 | 9/1966 | Apple . | |
| 3,610,558 | 10/1971 | Tawara . | |
| 3,888,438 | 6/1975 | Mizelle . | |
| 4,126,963 | 11/1978 | Dunbar | 248/523 X |
| 4,254,578 | 3/1981 | Hanfeld . | |
| 4,429,846 | 2/1984 | Halvorson . | |
| 4,477,049 | 10/1984 | Davis . | |
| 4,967,508 | 11/1990 | Reynolds | 248/523 X |
| 4,978,098 | 12/1990 | Peckinpaugh | 248/523 |
| 5,118,067 | 6/1992 | Gillanders . | |

*Primary Examiner*—Ramon O. Ramirez

*Attorney, Agent, or Firm*—Bell, Seltzer, Park & Gibson

[57] ABSTRACT

A Christmas tree stand having four legs of rigid material and rigidly interconnected so as to form a structure sufficiently strong to support a Christmas tree. Each of the legs of the stand are formed to allow a pan of water to sit beneath the stand. The inner end portions are disposed within the pan and are rigidly connected to an elongated retaining means such that the retaining means extends upwardly therefrom to receive the butt end portion of a pre-drilled or undrilled tree. A support plate is rigidly secured at the base of the elongated retaining means to receive the surface of the butt end of the tree. The tree is thus firmly and securely supported by the stand in an upright position and with the butt end immersed in the water.

6 Claims, 1 Drawing Sheet

CHRISTMAS TREE STAND

BACKGROUND OF THE INVENTION

Christmas trees are held upright by Christmas tree stands, which vary greatly in design and construction. Conventional tree stands are often complicated and cumbersome and require considerable time and effort to assemble and use. Most stands do not have a simple method of attachment to the tree and may require removal of the lower limbs to fit properly on the stand or to allow the attachment of fasteners. In addition, many stands include a multitude of parts which make the stands expensive to manufacture and complicated to assemble and adjust. See, for example, U.S. Pat. Nos. 4,429,846; 3,610,558; 3,250,504 and 2,905,414 which all disclose Christmas tree stands with complicated and time consuming mounting procedures.

It is often desirable to place the severed end of the trunk of the tree in a pan of water where the tree can take in water or other liquids. This keeps the tree fresh and lessens its susceptibility to fire. Many Christmas tree stands are designed to accommodate the use of a pan of water, but most of these require mounting the pan on a platform or tray. This arrangement is complicated and involves a high chance that the water will spill when the tree is removed from the pan. See, for example, U.S. Pat. No. 5,118,067 disclosing a wheeled Christmas tree stand having separate mounting brackets for the tree and the pan of the water, both of which are attached to the frame of the stand. Other tree stands have problems with water leaking from the openings that are formed in the pan which are necessary to accommodate the various mounting hardware. Although some Christmas tree stands have a single nail or screw extending vertically from the base of the stand which is received in the base of the tree to hold the tree upright, many of these tree stands, are not of sufficient rigidity to allow easy insertion of the spike or nail without the use of tools other than a hammer or mallet and may require that the tree be pre-drilled with a hole to allow insertion of the spike or nail. See, for example, U.S. Pat. No. 3,272,462 which discloses a stand with a separable central spike that is inserted into a pre-drilled hole in a tree. The spike is secured in a central opening in the pan with two locking nuts.

In addition, many conventional stands receive the flat, butt end of the tree against the bottom of the pan. This arrangement does not allow the tree to easily draw in water because the end of the tree is effectively sealed against the large flat surface of the bottom of the pan. See, for example, U.S. Pat. Nos. 4,429,846; 4,254,578 and 2,905,414.

It is therefore an object of the present invention to provide an improved Christmas tree stand having a single spike or screw for maintaining the tree upright.

It is another object of the present invention to provide a Christmas tree stand that can accommodate a pan of water with minimal risk of leakage or spillage of the water.

It is still another object of the present invention to provide a Christmas tree stand that has an easy and uncomplicated tree mounting procedure.

SUMMARY OF THE INVENTION

The present invention is a Christmas tree stand that presents numerous advantages over conventional Christmas tree stands in terms of ease use and manufacture.

The stand includes a plurality of legs formed of rigid material that are of the same shape and size and that are interconnected at their inner ends to form a substantially rigid structure. The outer end portions are of equal length and are adapted to allow the tree to stand upright on a supporting surface such as a table or floor. The stand has intermediate portions that are positioned above the outer end portions to form a support platform under which a pan of water can be placed. The inner end portions of the legs are positioned at an elevation above the outer end portions but below the intermediate portions so that the inner ends are disposed within the pan of water.

The inner end portions of the stand are adapted to receive the butt end portion of a tree and have an elongated retaining means that is attached and extends vertically from the intersection of the inner end portions of the legs. The legs and elongated retaining means are sufficiently rigid to allow the elongated retaining means to be inserted into the butt end of a pre-drilled or undrilled tree, thus retaining and supporting the tree on the stand in an upright position.

A support plate is connected to the inner end portion of the legs and surrounds the base of the elongated retaining means to provide a surface against which the tree can be buttingly received. This plate is preferably of such a diameter as to allow water in the pan to be drawn in by the tree through its butt end. End caps made of a resilient material such as plastic are fitted to the outer ends of the legs to prevent scratching of the supporting surface.

BRIEF DESCRIPTION OF THE DRAWINGS

The foregoing and other objects, advantages and features of this invention, and the matter in which the same are accomplished, will become more readily apparent upon consideration of the following detailed description of the invention taken in conjunction with the accompanying drawings, which illustrate preferred and exemplary embodiments, and wherein.

DETAILED DESCRIPTION OF THE PREFERRED EMBODIMENT

Figure 1:
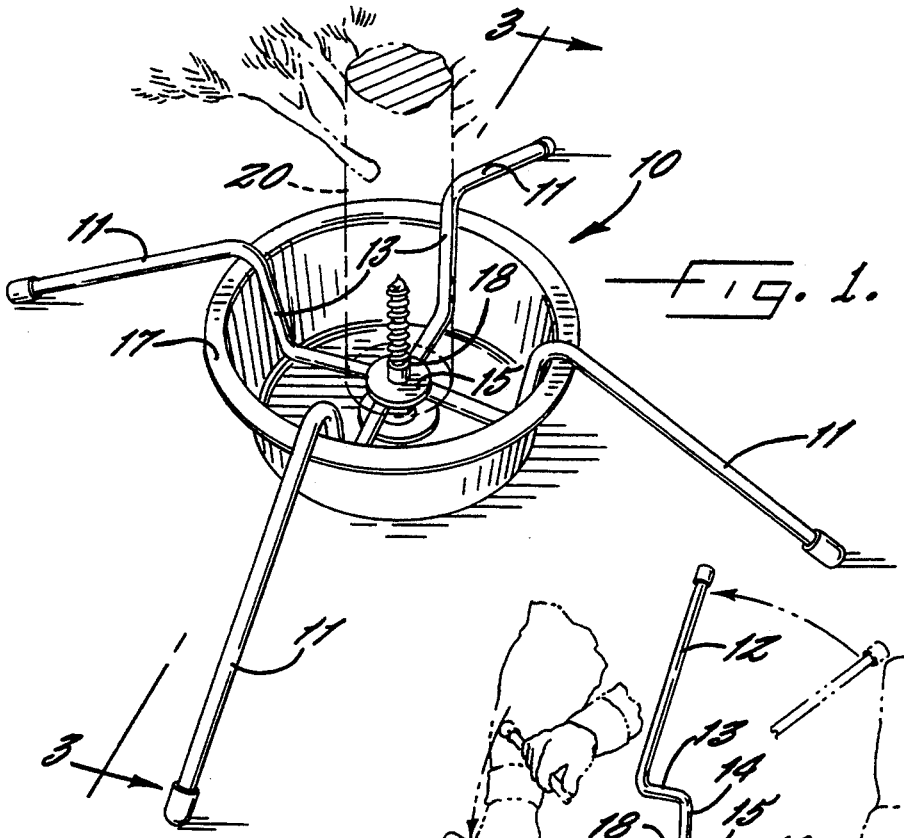
FIG. 1 is a perspective view of the tree stand of the present invention illustrating the position of the tree on the stand and the pan of water beneath the stand.
Figure 3:
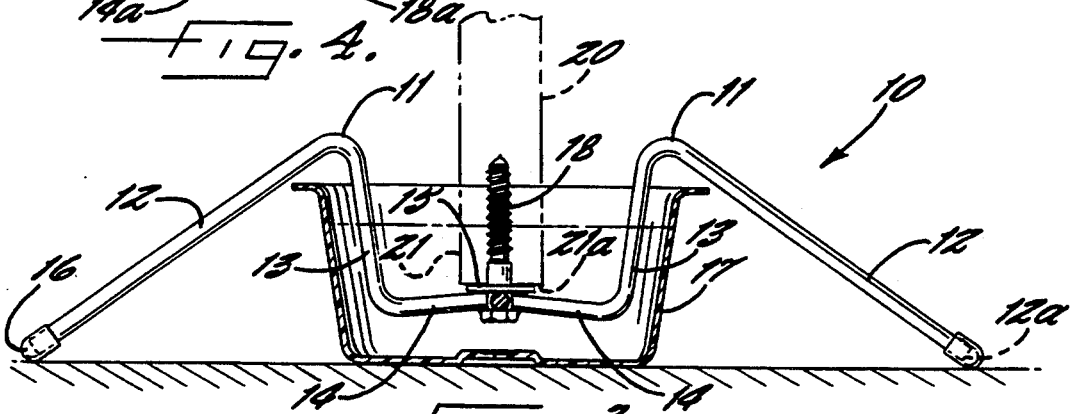
FIG. 3 is a sectional view of the tree stand of the present invention taken along line 3—3 as shown in FIG. 1; and, FIG. 4 is a fragmentary environmental and partially sectional view of the tree stand of the present invention taken along line 3—3 as shown in FIG. 1.

The Christmas tree stand 10 of the present invention includes four metal legs 11 of equal length and shape as shown in FIG. 1. The legs 11 are welded together at their inner ends 14*a*, as more fully discussed below, to form a substantially rigid structure capable of supporting the weight of a Christmas tree 20. As shown most clearly in FIG. 3, each leg 11 is bent in two places to form an outer end portion 12, an intermediate portion 13 and an inner end portion 14. The outer end portions 12 of the legs 11 are inclined and are of equal length so that the outer ends 12*a* can rest squarely on the floor or on a table and the tree 20 will be supported in a substantially vertical position. It would be readily understood to one skilled in the art that the leg span of the present invention can be varied to accommodate different tree sizes. It has been found that trees from less than three feet tall and up to twelve feet tall can be accommodated by tree stands of the present invention with leg spans ranging from 14 inches to 34 inches. While the legs may be made from any rigid material strong enough to support a tree, it is preferred to make the legs from steel rods of about ¼ to about ⅝ diameter. The outer ends 12*a* of the legs are fitted with end caps 16 made of a resilient material, such as plastic, vinyl or rubber, that prevent the ends 12*a* from scratching the floor or table upon which the stand 10 is supported.

The intermediate portion 13 of each leg 11 is generally vertically disposed and connects the outer end portions 12 of the legs 11 with the inner end portions 14. The bend in the leg that defines the intersection of the outer end portion 12 and the intermediate portion 13 of the leg is at a sufficient elevation above the outer ends 12*a* to allow a pan 17 of water to be placed beneath the stand. The imaginary cylinder formed by the walls of the pan 17 is concentric to and slightly larger than the imaginary cylinder formed by the generally vertical intermediate portions 13 of the legs 11 so that the intermediate portions 13 extend downwardly into the pan 17. The inner end portions 14 extend from the lower ends of the intermediate portions 13 of the legs 11 in a generally horizontal orientation and are disposed within the pan 17.

An elongated retaining means be 18 is connected to the inner ends 14*a* of the legs 11 and extends upwardly therefrom. The elongated retaining means 18 of the present invention is a conventional threaded bolt 18 although it would be readily understandable to one skilled in the art that other elongated means could be used, e.g., a spike or large nail. The bolt 18 is oriented vertically with the bolt head 18*a* at the lower end so that the inner ends 14*a* of the legs 11 are welded to the unthreaded shank 18*b* of the bolt and the threaded portion 18*c* of the bolt extends upwardly therefrom.

A support plate 15 of circular shape with a central hole formed therein is welded to the top surface of the inner end portions 14 of the legs 11 so that a the bolt 18 extends through the hole. The support plate 15 of the present embodiment of the invention is a conventional washer although it would be readily understood by one skilled in the art that other types of support plates could be used.

Figure 2:
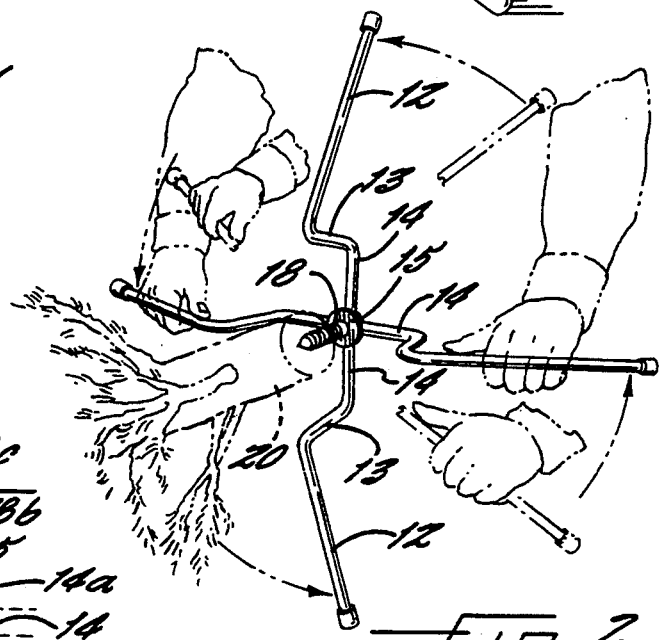
FIG. 2 is a perspective view of the tree stand of the present invention illustrating the procedure for mounting the tree on the stand.

The Christmas tree stand 10 of the present invention can be used to support both pre-drilled and undrilled Christmas trees. With pre-drilled trees, the bolt 18 is driven into the hole with a hammer until only a few threads remain visible. The head 18*a* of the bolt 18 provides a strong and convenient striking point for the hammer or mallet. The rigidity of the stand 10 and the arrangement of its legs 11 allow it to then be easily screwed into the tree 20, as shown in FIG. 2, until the butt end 21*a* of the tree is firmly abutted against the support plate 15. The stand 10 is then placed with the outer ends 12*a* of the legs 11 resting on a supporting surface so that the tree 20 is securely supported in an upright position. When securing undrilled trees to the stand 10, the bolt 18 is tapped into the tree 20 with a hammer until the first few threads are into the wood. The rest of the bolt 18 can then be easily screwed into the tree 20, as shown in FIG. 2, until the butt end 21*a* is secured against the support plate 15.

Figure 4:
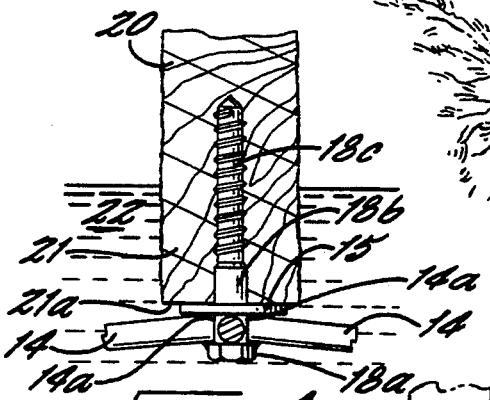

A pan 17 of water can be placed beneath the stand, as discussed above, so that the butt end portion 21 of the tree is immersed in the water 22. Water is drawn in by the tree 20 and this lessens the number of needles that are dropped by the tree during the Christmas season and minimizes the susceptibility of the tree to fire. The diameter of the support plate 15 is preferably smaller than the diameter of the butt end 21*a* of the tree 20 so that the water 22 can be easily drawn in by the bark and outermost rings of the trunk of the tree, as shown in FIG. 4. This arrangement is preferable to an arrangement where the entire surface of the butt end 21*a* of the tree is received against a support plate because the latter effectively seals the butt end against the support plate 15 and does not allow water to be freely drawn in by the tree 20. Since the bark and outermost rings are the portions of the trunk where the most water is drawn in by a tree 20, the support plate 15 of the present invention provides both additional support to the tree and unrestricted ingress for most of the water being drawn in by the tree.

While preferred embodiments of this invention have been illustrated in detail, it should be readily apparent to those skilled in the art that other embodiments may be conceived and fabricated without departing from the spirit and scope of this invention.

What which is claimed is:

1. A Christmas tree stand comprising a central support member, a plurality of legs extending radially outwardly from said central support member, each of said legs consisting of a unitary rigid rod having an inner end connected to said central support member, and an outer end which is adapted to rest upon a horizontal supporting surface, and with each of said legs being configured to define, when viewed in side elevation, (a) an upwardly inclined outer end portion extending from said outer end to an elevated medial portion, (b) an intermediate portion extending downwardly from said elevated medial portion to a lower medial portion, and (c) a generally horizontal inner end portion extending from said lower medial portion to said inner end of said rod, and said central support including an upwardly extending externally threaded member which is adapted to be threaded into a bore in the base of the tree for securing the stand to the tree.

2. The Christmas tree stand as defined in claim 1 wherein said inner end portions of said legs lie at an elevation intermediate that of said outer ends and said elevated medial portions of said legs.

3. The Christmas tree stand as defined in claim 1 wherein said central support member further includes a horizontal support plate positioned to surround said threaded member and so as to be adapted to engage the base of the supported tree.

4. The Christmas tree as defined in claim 3 wherein said legs are each characterized by the absence of reinforcing members connected thereto.

5. The Christmas tree stand as defined in claim 4 wherein four of said legs are provided which are disposed in an X-shaped arrangement when viewed in top plan.

6. The Christmas tree stand as defined in claim 5 further comprising a water pan which includes a base wall and a surrounding upstanding wall, and with said upstanding wall being sized so as to be received circumferentially between said outer end portions and said intermediate portions of said legs when said water pan is placed on the supporting surface below said legs.

* * * * *